United States Patent [19]

Spademan

[11] Patent Number: 4,465,295

[45] Date of Patent: Aug. 14, 1984

[54] DYNAMIC SKI BOOT POSITIONING APPARATUS

[76] Inventor: Richard G. Spademan, Box 6410, Incline Village, Nev. 89450

[21] Appl. No.: 572,127

[22] Filed: Jan. 19, 1984

Related U.S. Application Data

[63] Continuation-in-part of Ser. No. 230,530, Feb. 2, 1981, abandoned.

[51] Int. Cl.[3] ..... A63C 9/08

[52] U.S. Cl. ..... 280/612; 280/617; 280/624

[58] Field of Search ..... 280/611, 613, 607, 616, 280/617, 618, 633, 634, 636, 637, 624, 612, 625

[56] References Cited

FOREIGN PATENT DOCUMENTS 2352433 4/1975 Fed. Rep. of Germany ..... 280/611

2457110 1/1981 France ..... 280/11.36

*Primary Examiner*—Joseph F. Peters, Jr.
*Assistant Examiner*—Michael Mar
*Attorney, Agent, or Firm*—Townsend and Townsend

[57] ABSTRACT

A ski binding having a portion which holds the ski boot and moves relative to a ski over a predetermined distance and in predetermined directions, which may be perpendicular to each other, relative to the ski. The binding employs a mechanical or electromechanical transducer for sensing the skier's movement which triggers a relative movement of the binding. Guides are provided to direct and limit the movement of the binding. A power activator for the binding is generally disposed between the sole of the ski boot and the ski and utilizes relatively minor movements of the ski boot sole, or electrical power, to move the binding portion relative to the ski.

21 Claims, 15 Drawing Figures

50
51
60
61
62
20
2
3
28
24
27
23
22
26
25
21
5
7
12
6
10
14
13
11
64
63
65
52
53
54

POWER SOURCE
64
SOLENOID ASSEMBLY
52
54
HOUSING
51
CONTROL
63
TRANSDUCER
61

DYNAMIC SKI BOOT POSITIONING APPARATUS

RELATED APPLICATION

This is a continuation-in-part of applicant's application Ser. No. 230,530 filed Feb. 2, 1981 now abandoned.

BACKGROUND OF THE INVENTION

The present invention relates to alpine ski bindings in general and in particular to dynamic skit boot positioning apparatus for dynamically positioning a skier's weight on a ski.

A ski is often turned using a carved turn, by sideslipping the tail of the ski, or by a combination of both maneuvers. Comparing both maneuvers, carved turns in both racing and recreational skiing are most efficient, while sideslipping the tail of a ski is characterized by a frequently undesirable dissipation of energy.

To properly execute a carved turn, a ski must be rolled on edge with sufficient pressure to bend it into reverse camber. To be sufficient the arc of the reverse camber must be equal to the arc of the turn. Consequently the sharper the turn, the greater is the pressure required.

Generally, the pressure required for a carved turn is applied to a ski using either forward leverage, neutral leverage or back leverage, depending upon the conditions and the performance desired. Forward leverage is applied to the ski by a skier shifting his or her weight toward the tip of the ski and applying forward pressure thereto. Neutral leverage is applied to the ski by a skier assuming a neutral position over the waist of the ski. Back leverage is applied to the ski by a skier shifting his or her weight toward the tail of the ski and applying back pressure thereto.

Most carved turns are initiated with forward leverage to increase control of the ski tip. Forward leverage places the most severe part of the reverse camber toward the tip of the ski; however, if forward leverage is maintained throughout a turn, the tip acts as a brake and causes excessive chatter. For this reason, as soon as the tip establishes the desired arc of the turn, the pressure on the ski is typically moved to the center of the ski or in a position of neutral leverage.

Neutral leverage flexes the ski on a nearly smooth arc. Consequently, sustained turns are best made with neutral leverage.

Back leverage moves the sharpest bend of reverse camber toward the tail of a ski. However, sustained turns generally cannot be carved with back leverage because the ski side-cut is less severe in the back half of the ski than in the front half. Consequently, back leverage is best used for long radius turns on relatively flat terrain or soft snow, although on steeper terrain, turns are often ended with back leverage to provide acceleration. Notably, a most important use of back leverage is to complete with a carving action all turns that are begun by steering a relatively flat ski.

During normal skiing, the majority of a skier's weight is located at the center section of a ski. However, during a turn, subtle changes in leverage will distribute the skier's weight sufficiently ahead or behind the waist of the ski to carve a turn on the front or on the back of the ski. Because of this characteristic of skis, carving the tip of the ski requires only moving the balance point slightly ahead of the waist of the ski. Likewise, carving the tail of a ski requires only a slight rearward balance adjustment.

SUMMARY OF THE INVENTION

For the foregoing reasons, a principal object of the present invention is a ski binding with means for dynamically distributing a skier's weight on a ski.

Another object of the present invention is a ski binding as described above comprising means for dynamically changing the position of a ski boot on a ski.

In accordance with the above objects there is provided in a plurality of mechanical and electrical embodiments of the present invention mechanical and electrical assemblies each responsive to the movement of a skier for moving the skier's ski boot forwardly and rearwardly and medially and laterally relative to a ski.

In one of the electrical embodiments there is provided an electrical transducer assembly mounted under the toe of a ski boot. The transducer assembly is provided to be responsive to changes in the pressure a skier's movement exerts thereon for moving the ski boot forwardly and rearwardly relative to a ski.

In the mechanical embodiments there is provided a mechanical assembly responsive to foot lifting or leg movement for dynamically controlling the position of a ski boot relative to a ski.

In other electrical embodiments of the invention there is provided in a ski boot, a sole mounted, tongue mounted, or cuff mounted transducer which is responsive to a skier's movement for providing a electrical signal corresponding to the magnitude and direction of the movement. The electrical signal is provided for controlling a solenoid. The controlling of the solenoid controls the position of the ski boot on a ski.

In one of the electrical embodiments, multiple transducer and solenoid assemblies are employed. With multiple transducers and solenoid assemblies, differential movement of the ski boot relative to a ski in both a lateral and a longitudinal direction is possible.

BRIEF DESCRIPTION OF THE DRAWING

The above and other objects, features and advantages of the present invention will become apparent from the following detailed description of the accompanying drawing in which.

DETAILED DESCRIPTION OF THE DRAWING

Figure 1:
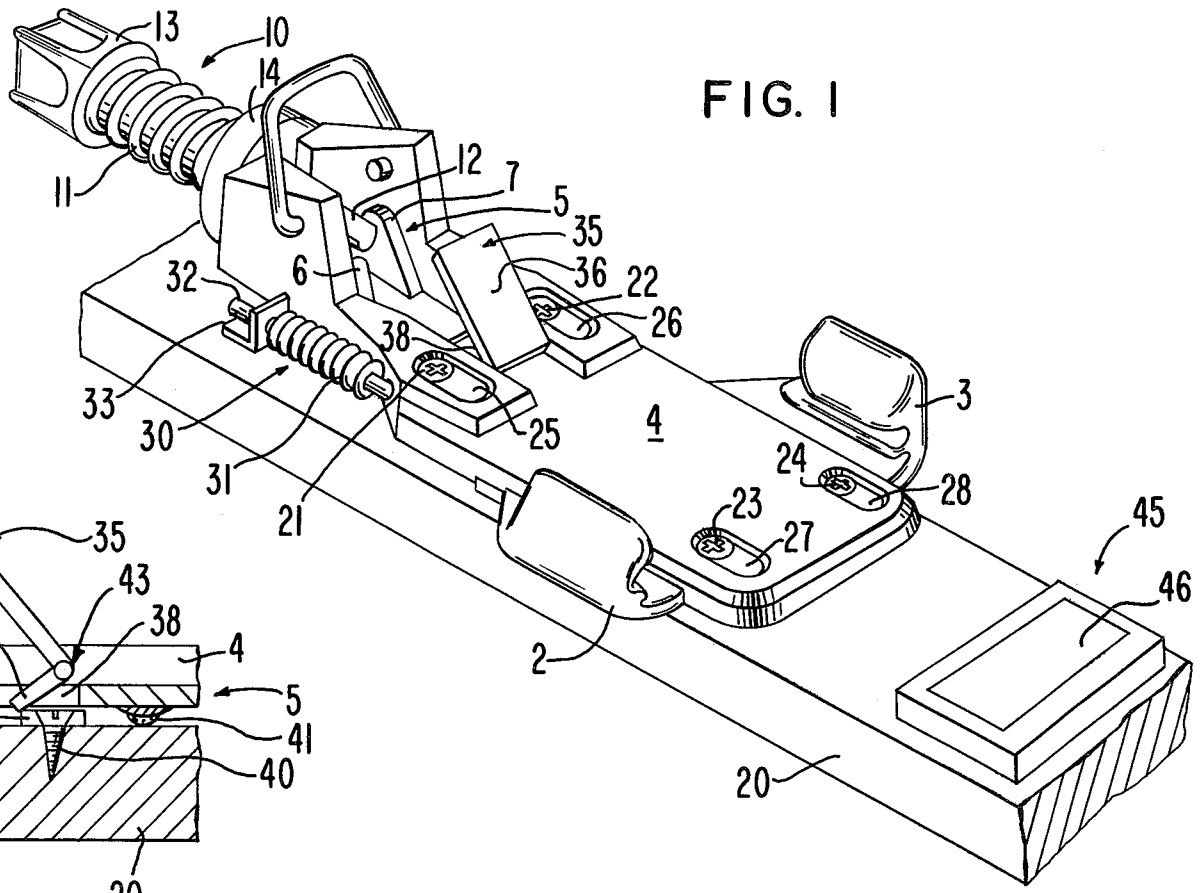
FIG. 1 is a perspective view of a mechanical embodiment of the present invention in a side clamp binding showing a heel lever assembly.
Figure 2:
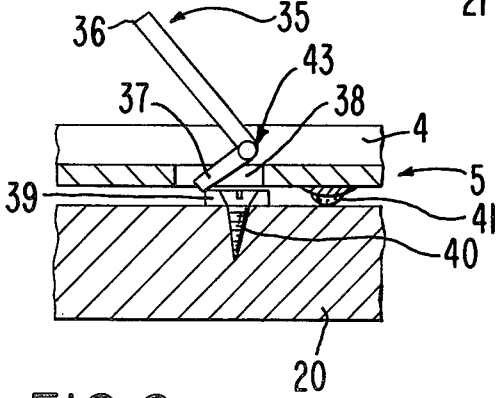
FIG. 2 is a partial cross-sectional view of the heel lever assembly of FIG. 1.

Referring to FIGS. 1 and 2 there is provided in accordance with the present invention a releasable ski binding designated generally as 1 for releasably securing a ski boot (not shown) to a ski 20 rearward of the toe and forward of the rear of the heel of the ski boot. At the forward end of the binding 1 there is provided a pair of laterally movable side clamping members 2 and 3. Clamping members 2 and 3 are movably mounted in a housing 4 to a T-shaped connecting member designated generally as 5. At its rear end the T-shaped connecting member 5 is provided with a pair of upstanding members 6 and 7 for movably coupling the T-shaped connecting member 5 to an overcenter force unit designated generally as 10. In the force unit 10 there is provided a spring 11, a spring guide rod 12, a a spring adjusting nut 13 threaded onto the end of the rod 12 and a spring washer 14 for providing a clamping force for the clamping members 2 and 3 through the connecting member 5.

The binding 1 is movably mounted to the ski 20 by means of a plurality of screw members 21, 22, 23 and 24. The screw members 21–24 are mounted in a plurality of elongated slots 25, 26, 27 and 28 respectively.

Extending rearwardly from the rear of the housing 4 in the vicinity of the slot 25 there is provided a spring assembly designated generally as 30. In the spring assembly 30 there is provided a spring 31, a spring guide rod 32 and an L-shaped mounting bracket 33. The forward end of the rod 32 is fixedly attached to the housing 4. The rear of the rod 32 is slidably inserted through a hole provided therefor in the bracket 33. An identical spring assembly (not shown) is symmetrically provided on the opposite side of the binding 1.

Between the screws 21 and 22, there is movably mounted an L-shaped lever assembly 35. As shown in FIG. 2, the lever assembly 35 is mounted for movement about an axis designated as 43.

Referring to FIG. 2, the lever assembly 35 is provided with a heel receiving arm 36 and an arm 37 extending at an angle therefrom. The arm 37 extends through a slot 38 provided therefor in the connecting member 5.

Mounted to the top of the ski 20 as by a screw 40 there is provided a block 39 adjacent to the arm 37.

In suitable locations between the housing 4 and the ski 20 for facilitating movement of the binding 1 relative to the ski 20 there is provided a plurality of spherically shaped bearing members 41 (only one of which is shown). Roller bearings can also be used.

Forward of the binding 1 there is provided a coventional toe rest designated generally as 45. In the toe rest 45 there is provided a low friction surface 46.

Except as herein described, the binding 1 is substantially equivalents to and functions in the same manner as the side clamping bindings shown and described in applicant's prior U.S. Pat. No. 3,606,370.

In operation, with a ski boot secured between the clamping members 2 and 3 in a conventional manner as described in U.S. Pat. No. 3,606,370, the heel of the ski boot presses down on the arm 36 of the lever assembly 35. With the heel of the ski boot pressing downwardly on the arm 36, the lever assembly 35 is pivoted about the axis 43 forcing the arm 37 against the ski mounted block 39. When the member 37 is forced against the ski mounted block 39, the binding 1 is held in a rearward position against the force of the spring 31 in the spring assembly 30.

To turn a ski using a carved turn rather than an energy dissipating turn accomplished by slipping the tail of the ski, a skier edges the skis and leans forwardly in the binding. As the skier leans forwardly in the binding, the heel of the ski boot undergoes heel lifting movement. In a typical embodiment, the amount of heel lifting movement is approximately ½ inch. As the heel of the ski boot lifts during forward leaning, heel pressure on the lever assembly 35 is relieved, allowing the binding 1 to be pushed forwardly by the spring 31. The forward movement of the ski boot and the binding 1, as the heel of the ski boot undergoes heel lifting movement, dynamically shifts the weight of the skier forwardly on the ski. Conversely, as a skier lowers his or her heel, the downward movement of the lever assembly 35 moves the binding 1 rearwardly on the ski 20.

Figure 3:
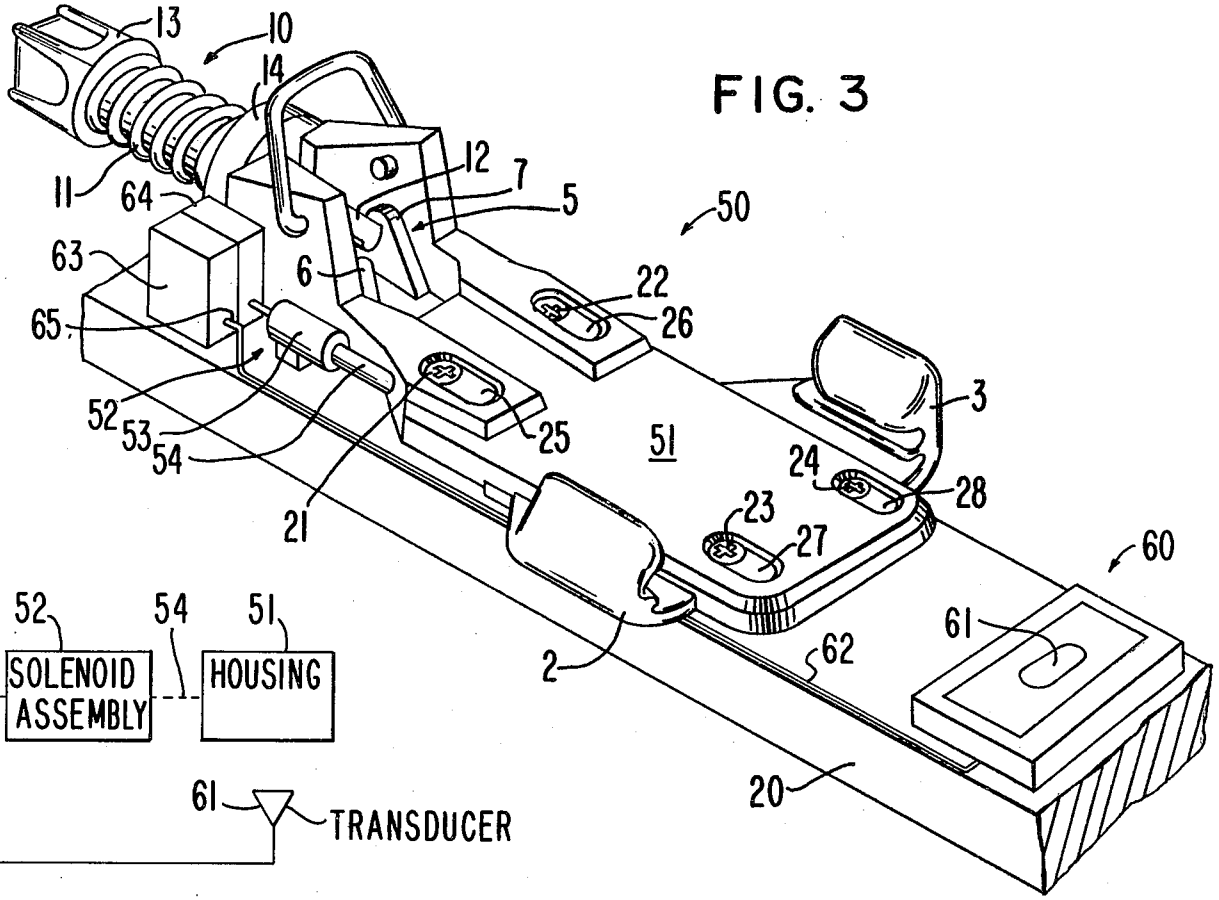
FIG. 3 is a perspective view of an electrical embodiment according to the present invention showing a transducer at the toe of a binding.
Figure 4:
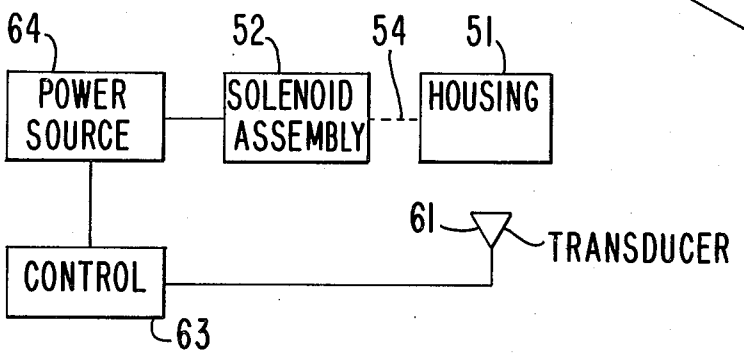
FIG. 4 is a schematic of the binding of FIG. 3.

Referring to FIG. 3 and as shown in the schematic of FIG. 4, there is provided in another embodiment of the present invention a ski binding designated generally as 50 comprising a housing 51. Except as hereinafter described, the ski binding 50 is substantially identical to the ski binding of FIG. 1 and operates in the same manner for releasably securing a ski boot to a ski rearward of the toe and forward of the rear of the heel of the ski boot. For convenience, those features of the binding 50 which are identical to those in the binding of FIG. 1 are identified using the same numbers used in FIG. 1.

Forward of the housing 51 there is provided a toe rest designated generally as 60. In the toe rest 60 there is provided a transducer assembly 61. At the rear of the housing 51 there is provided a conventional solenoid control circuit 63, power supply assembly 64, and a solenoid assembly 52 comprising a solenoid 53. In the power assembly 64 there is provided a source of power such as a battery (not shown). The transducer assembly 61 is coupled to the control circuit 63 by means of a signal line 62. The control circuit 63 is coupled to the power supply assembly 64 internally by conventional means not shown. The power supply assembly 64 is coupled to the solenoid assembly 64 by a signal line 65. The signal line 62 is provided, as will be described, for providing to the control circuit 63 a signal corresponding to the magnitude of the pressure applied to the assembly 61 by the toe of a ski boot secured in the binding 50. The signal line 65 is provided for providing a corresponding change in power to the solenoid assembly 52 for operating the solenoid 53.

In the solenoid assembly 52, the solenoid 53 is provided with a piston member 54. In practice, the assembly 52 is fixedly mounted to the ski 20 with the piston 54 fixedly attached to the housing 51.

In operation, during a turn, as a skier edges and leans forward in the binding 50, there is an increase of pressure on the assembly 61 of the toe piece 60 by the toe of the ski boot. As the pressure from the toe of the ski boot increases on the assembly 61 a signal generated on the line 62 is transmitted to the solenoid assembly 52 which causes the solenoid assembly 52 to move the ski boot and binding 50 forwardly relative to the ski 20.

When a skier reduces the forward lean and relieves the pressure on the assembly 61 of the toe piece 60, the signal on the signal line 62 is adjusted. As the signal on the line 62 is adjusted, the ski boot and binding 50 is moved rearwardly relative to the ski 20 under the control of the solenoid assembly 52. If necessary, a spring member (not shown) may be employed for moving the binding 50 rearwardly relative to the ski as toe pressure is relieved from the member 61.

For certain applications, symmetrically located on the opposite side of the housing 51, there is provided an identical solenoid assembly 52 and an extension of the signal line 62 coupled thereto. The use of a pair of symmetrically mounted solenoid assemblies 52 reduces the amount of force required of each of the assemblies 52 to move the ski boot and binding 50 forwardly and rearwardly relative to the ski 20.

Figures 5, 5A:
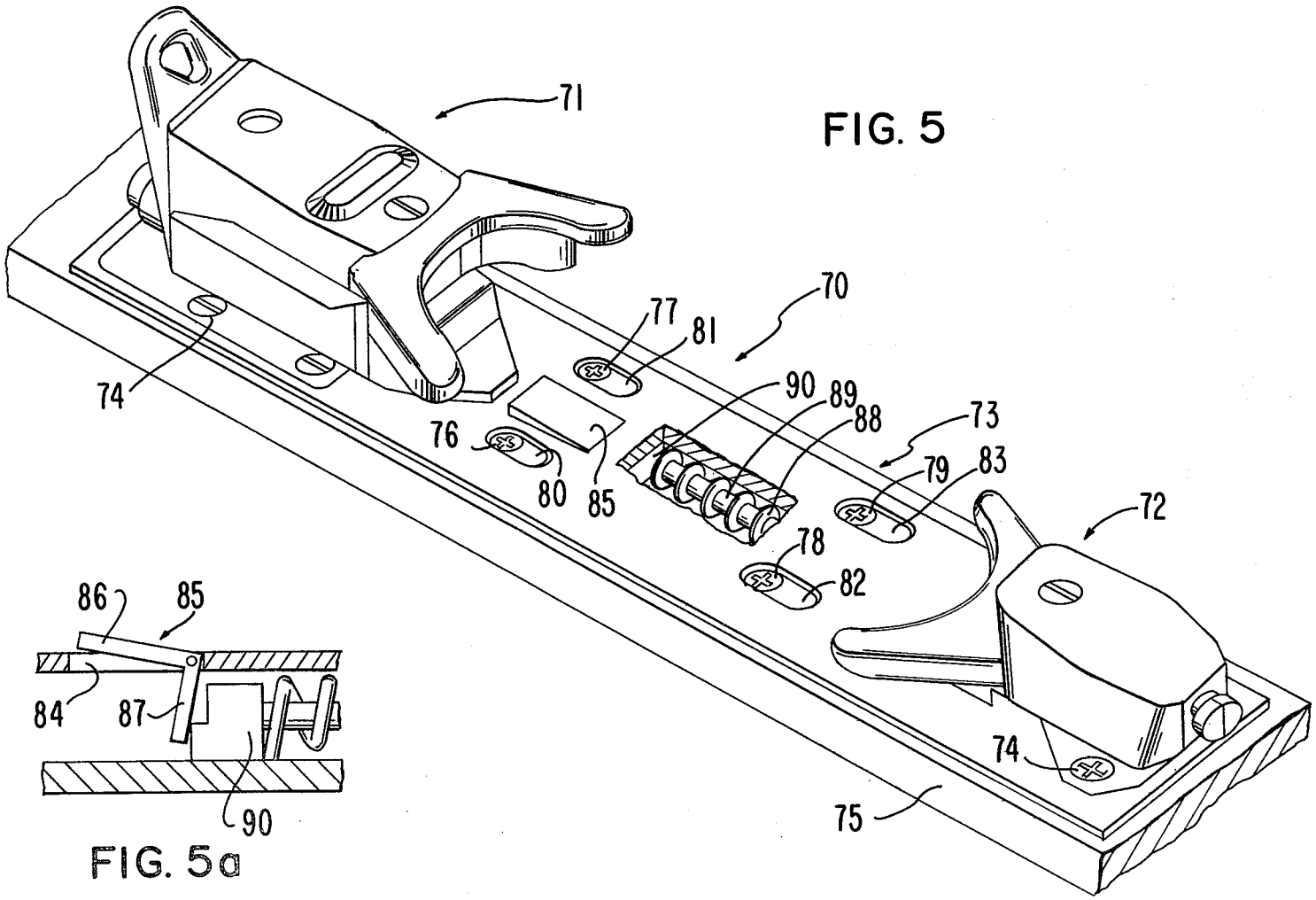
FIG. 5 is a mechanical embodiment of the present invention showing a heel lever assembly in a toe-heel binding.
FIG. 5*a* is a partial cross-sectional view of the heel lever assembly of FIG. 5.

Referring to FIGS. 5 and 5*a*, there is provided a toe-heel binding designated generally as 70. In the binding 70 there is provided a conventional heel clamping assembly 71 and a conventional toe clamping assembly 72. The heel clamping assembly 71 and the toe clamping assembly 72 are each mounted in a conventional manner to a plate 73 by a plurality of screws 74. The plate 73 is in turn movably mounted to a ski 75.

To movably mount the plate 73 to the ski 75, there is provided a plurality of screw members 76, 77, 78 and 79 slidably mounted in a plurality of elongated slots 80, 81, 82 and 83 provided therefor in the plate 73.

Between the slots 80 and 81 there is movably mounted in a slot 84 provided therefor in the plate 73 a movable lever assembly 85. In the lever assembly 85, there is provided a heel receiving arm 86, a lower arm 87 and a ski mounted block 90. The lever assembly 85, the arms 86 and 87 and the block 90 correspond to the lever assembly 35, the arms 36 and 37 and block 39 of the embodiment of FIGS. 1 and 2.

Between the rearward slots 80 and 81 and the forward slots 82 and 83 there is provided in a space provided therefor beneath the plate 73 as shown in a cutaway view thereof a spring 88 mounted on a spring guide rod 89 abutting the ski mounted block 90.

As described above with respect to the embodiment of FIGS. 1 and 2 there is also provided bearing members or the like (not shown) for providing a low friction means for facilitating movement of the plate member 73 relative to the ski 75.

In operation during a carving turn with forward leverage, a skier leans forwardly in the binding 70. As the skier leans forwardly in the binding 70, the ski boot undergoes heel lifting movement. As the ski boot undergoes heel lifting movement, the arm 87 of the lever assembly 85 is removed from the ski mounted block 90. As the arm 87 of the assembly 85 is removed from the ski mounted block 90, the spring 88 moves the ski boot and binding 70 forwardly relative to the ski 75 in the manner described above with respect to the binding 1 of FIG. 1. Similarly as described above with respect to the binding of FIG. 1, when a skier lowers the heel of his ski boot and applies pressure to the lever member assembly 85, the lever assembly 85 engages the ski mounted block member 90 and moves the ski boot and ski binding 70 rearwardly relative to the ski 75.

The position of the ski boot and binding 70 on the ski 75 also can be controlled by a pressure responsive transducer and a solenoid assembly coupled thereto as described above with respect to the embodiment of FIGS. 3 and 4. This may be accomplished by replacing the lever assembly 85 with a pressure responsive transducer corresponding to the transducer 61 and coupling thereto, a solenoid assembly corresponding to the solenoid assembly 52 described above with respect to the embodiment of FIGS. 3 and 4.

Figure 7:
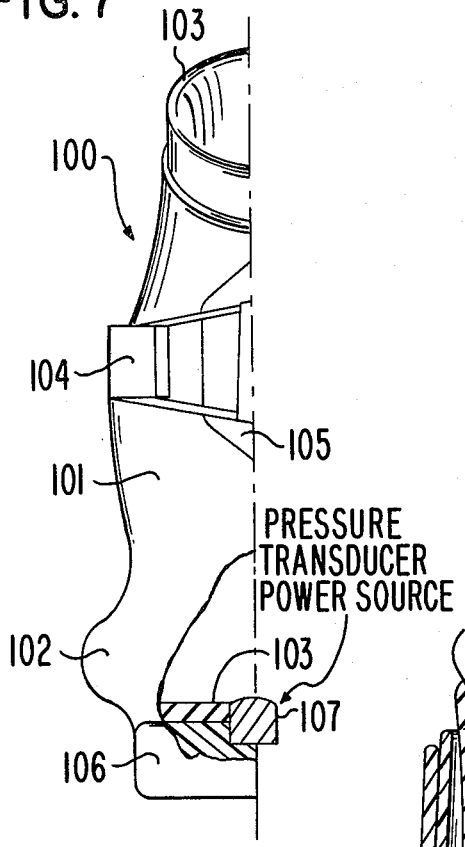
FIG. 7 is a partial cross-sectional view of the embodiment of FIG. 6.
Figure 6:
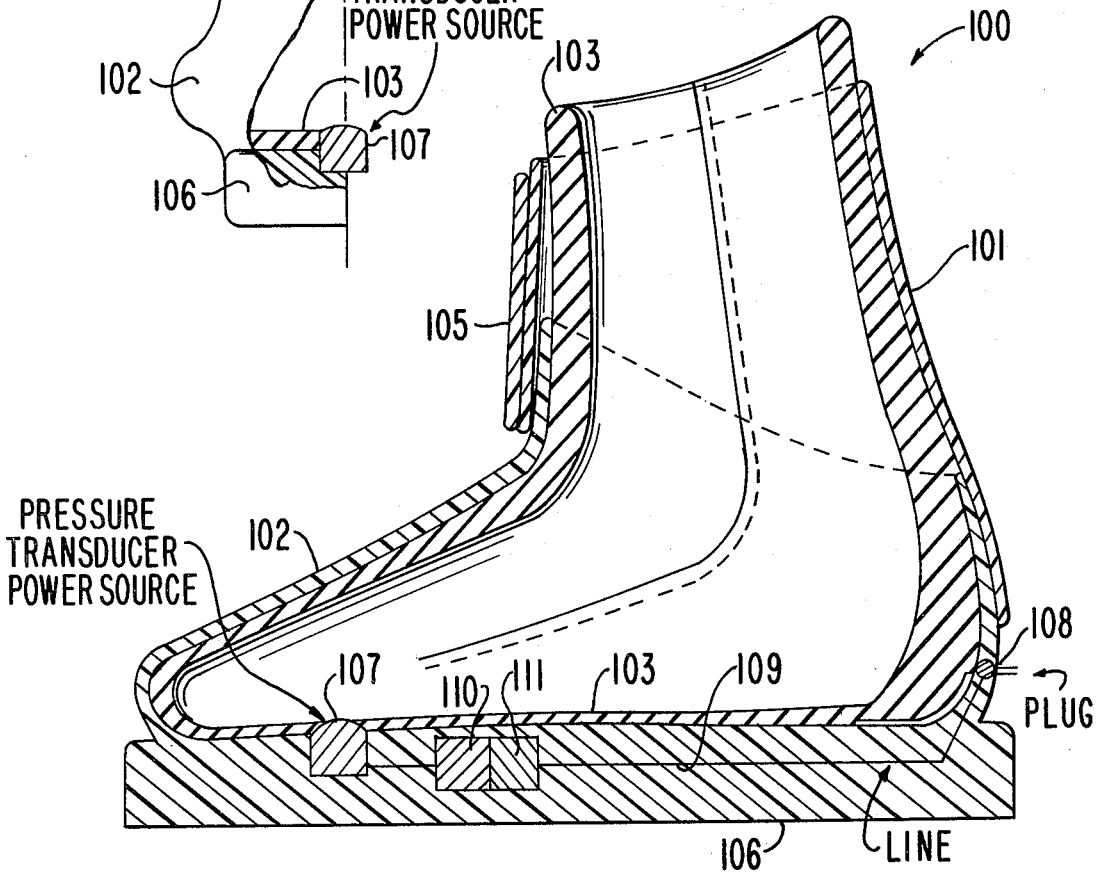
FIG. 6 is a cross-sectional view of another electrical embodiment of the present invention employing a sole mounted transducer in a ski boot.

Referring to FIGS. 6 and 7, there is provided in an alternative embodiment of the present invention a ski boot designated generally as 100. In the ski boot 100 there is provided a cuff member 101 and a lower, relatively rigid shell member 102. In the interior of the cuff member 101 and the shell member 102, there is provided for warmth and comfort a resilient, relatively soft liner 103. A cuff buckle assembly 104 is provided attached to a cuff flap 105 for opening and closing the cuff 101 during the insertion and removal of a foot in and from the ski boot 100.

The shell member 102 is fitted to a ski boot sole member 106. Mounted in the sole member 106 along the longitudinal axis thereof and in the vicinity of the ball of the foot, there is provided a transducer 107, a control circuit 110 and battery power supply assembly 111. The transducer 107, control circuit 110 and power supply assembly 111 are connected to an electrical connector 108 located at the heel of the ski boot 100 by means of an electrical conductor 109.

The transducer 107, control circuit 110 and power supply assembly 111 are preferably a pressure transducer control circuit and power supply assembly corresponding to the pressure transducer 61, control circuit 63 and power supply assembly 64 described above with respect to the embodiment of FIGS. 3 and 4. However, as described above with respect to the embodiments of FIGS. 3 and 4, other types of transducers, control circuits and power supply assemblies may be used.

In practice, the ski boot 100 is used with a binding assembly as described above with respect to FIG. 3. When used with a binding assembly as described above with respect to FIG. 3, the toepiece 60 is replaced by a conventional toepiece such as that described above with respect to the toepiece 45 of FIG. 1. With a conventional toepiece as described above with respect to FIG. 1, the electrical signal line 62 is coupled to the electrical fitting 108 at the heel of the ski boot 100 by means of a conventional female plug or the like (not shown). In practice, when this is done, the line 62 extends from the boot 100 to the solenoid 53.

In this application, the line 62 and its fitting and the mating fitting 108 are constructed of rugged materials and secured in such a fashion well known to those skilled in the art to withstand the tension which is applied thereto during a separation of fittings during an involuntary release of the ski boot 100 from the binding.

In an alternative embodiment using the binding of FIG. 3, the control circuit 110 and power supply 111 may be omitted from the boot 100 and the line 62 connected from the boot 100 to the control circuit 63 for operating the binding 50, as described above.

In a typical embodiment of the invention of FIGS. 6 and 7, the cuff 101 is pivotally mounted to the shell member 102 for rotational movement about an axis in the vicinity of the ankle. However, it should be understood that the invention may also be employed in ski boots commonly known as one piece ski boots in which the cuff member is an integral part of the lower shell member.

Figure 8:
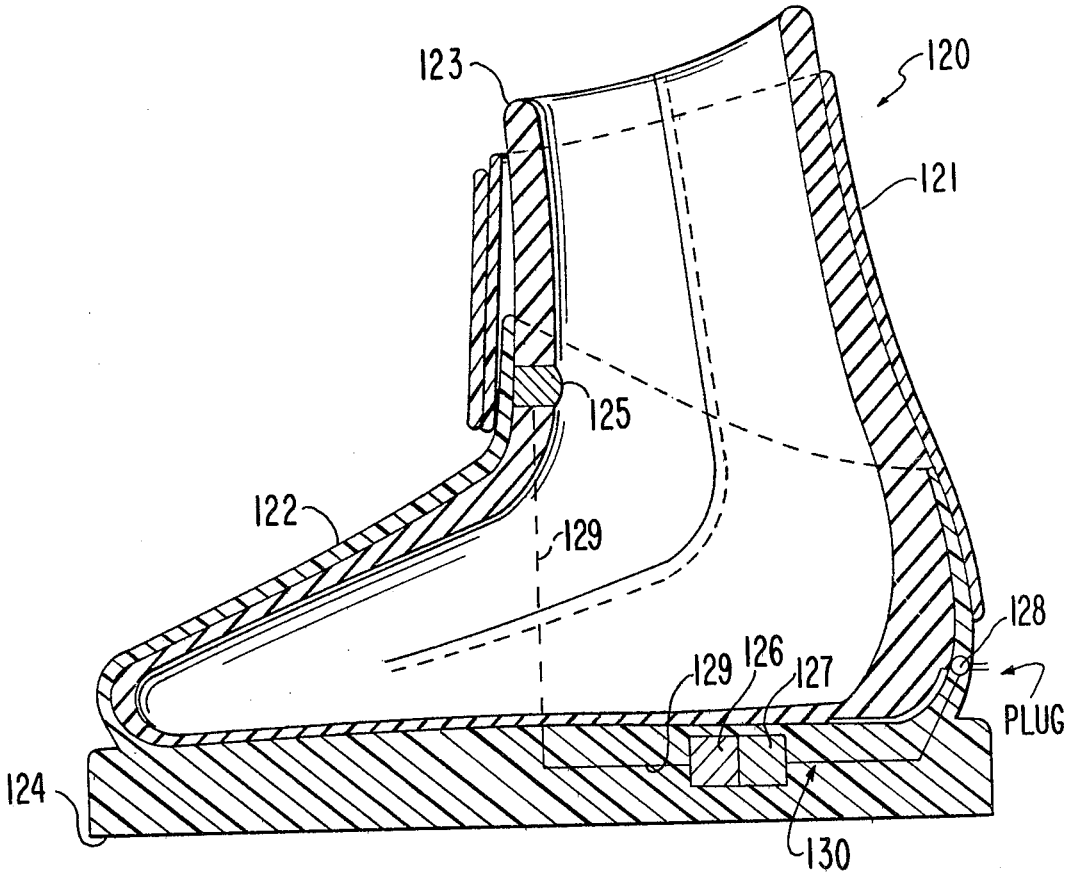
FIG. 8 is a cross-sectional view of another electrical embodiment of the present invention employing an upper instep or cuff-mounted transducer in a ski boot.
Figure 9:
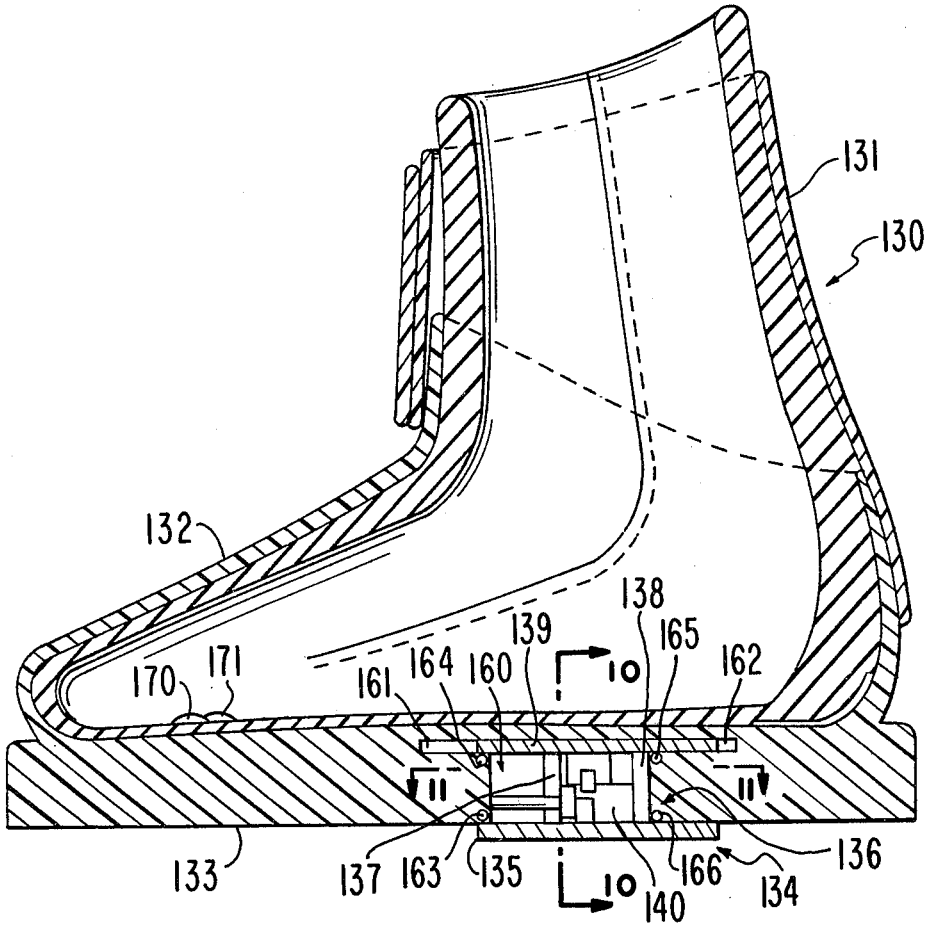
FIG. 9 is a cross-sectional view of another electrical embodiment of the present invention employing a sole mounted movable plate assembly in a ski boot.
Figure 10:
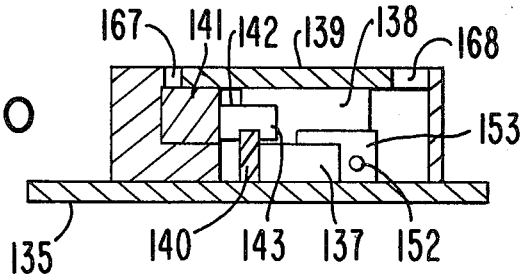
FIG. 10 is a cross-sectional view taken along lines 10—10 of FIG. 9.

Referring to FIG. 8 there is provided, in still another embodiment of the present invention, a ski boot designated generally as 120 which in certain applications may be used in place of the ski boot 100 of FIGS. 6 and 7. In the ski boot 120, there is provided a cuff member 121 and a lower shell member 122. In the interior of the cuff and shell members 121 and 122 there is provided, for warmth and comfort, a relatively soft resilient liner 123. The shell member 122 is fitted to a sole 124. Mounted along the midline of the shell member 122, in the vicinity of the instep and near the upper edge of the shell member 122, there is provided a pressure transducer 125, control circuit 126 and power supply assembly 127 which extends through the liner 123 to be contacted by a lower forward portion of a skier's leg. At the rear of the ski boot 120 there is provided an electrical fitting 128 which is electrically coupled to the transducer 125, control circuit 126 and power supply assembly 127 by means of an electrical conductor 129. The electrical conductor 129 is typically routed from the electrical connector 128 through a space provided therefor in the sole 124 and then upwardly along the inside of the shell 122, between the shell 122 and the liner 123, to the transducer 125, control circuit 126 and power supply assembly 127.

In use, when a skier leans forward, the pressure of the lower forward part of the leg against the transducer 125 increases. As the pressure against the transducer 125 increases, a corresponding signal is generated on the conductor 129 and the signal line 62 coupled thereto by means of the electrical connector 128 as described above with respect to the embodiment of FIGS. 3, 6 and 7. In response to the signal on the lines 129 and 62, the solenoid 53 moves the binding 50 forwardly relative to the ski. Conversely, as the skier leans rearwardly relieving the pressure on the transducer 127, the resulting change in signal on the lines 128 and 62 results in the solenoid 53 moving the binding 50 rearwardly relative to the ski.

As described above with respect to the embodiment of FIGS. 6 and 7, when the boot 120 is used with the binding of FIG. 3, the control circuit 126 and power supply assembly 127 can be omitted and the boot 120 converted by the lines 129 and 62 to the solenoid 53 through the control and power supply circuits 63 and 64.

Referring to FIGS. 9–12, there is provided in still another embodiment of the present invention a ski boot designated generally as 130. In the boot 130 there is provided a cuff member 131 and a substantially rigid shell member 132 mounted on a sole member 133.

Located in an inverted square hat-shaped cavity 160 in the sole member 133, there is provided a movable ski boot plate assembly designated generally as 134.

In the movable plate assembly 134 there is provided a boot plate 135. Extending upwardly from the boot plate 135 and attached thereto as by screws (not shown) there is provided a U-shaped member designated generally as 136. The U-shaped member 136 is provided with a pair of spaced leg members 137 and 138. The leg members 137 and 138 are fixedly attached to a plate member 139 at the top of the movable assembly 134. Extending between the leg members 137 and 138 and fixedly attached thereto, there is provided a wall member 140.

Mounted in a cavity provided therefor in the sole 133, there is provided a solenoid assembly 141. In the solenoid assembly 141, there is provided a movable piston 142. Near the end of the movable piston 142 there is provided a transverse slot 143. The slot 143 is provided for slidably engaging the wall member 140 of the U-shaped member 136.

Extending outwardly from the wall member 140 of the U-shaped member 136, between the leg members 137 and 138, there is provided a relatively low leg member 144.

In another cavity provided therefor in the sole 133, there is provided a second solenoid assembly designated generally as 150. In the solenoid assembly 150, there is provided an L-shaped piston assembly 151, having a leg 152 and a leg 153. The leg 152 extends parallel to the longitudinal axis of the solenoid assembly 150 and the leg 153 extends perpendicular from the leg 152. The end of the leg 153 is slidably fitted between the leg member 137 and the wall member 144 of the U-shaped member 136. As will be noted, the height of the wall member 140 and the leg member 144 is sufficiently low that the free end of the piston member 142 of the solenoid assembly 141 clears the top of the wall member 140 and the leg member 144 as the piston member 142 moves back and forth along the wall member 140.

Extending forwardly and rearwardly from the top of the cavity 160, there is provided a pair of recesses 161 and 162. The recess 161 is provided for slidably receiving the forward end of the plate member 139 and the recess 162 is provided for slidably receiving the rearward end of the plate member 139 as the movable assembly 134 is moved forwardly and rearwardly as will be described below. For movably supporting the plate members 139 and 135, there is provided a plurality of ball bearing members 163, 164, 165 and 166. The bearing members 163–166 are provided for reducing the friction between the plate members 135 and 139 and the sole member 133 as the movable assembly 134 is moved forwardly and rearwardly and from side to side relative to the sole 133 as will be described below. To provide clearance along the lateral edges of the plate member 139 for permitting transverse movement of the plate 139, there is provided a pair of clearance spaces 167 and 168.

To operate the solenoid assemblies 150 and 141, there is provided a longitudinal transducer control circuit and power supply assembly 170 and a lateral transducer control circuit and power supply assembly 171. The assembly 170 is mounted in the sole 133 along the longitudinal axis thereof. The assembly 171 is mounted in the sole 133 along the lateral edge thereof. Both of the assemblies 170,171 are mounted in the vicinity of the ball of a skier'foot and are responsive to changes in pressure thereon. The assembly 170 is connected to the solenoid 150 by means of an electrical conductor 172 embedded in the sole 133. The assembly 171 is connected to the solenoid assembly 141 by means of an electrical conductor 173 in the sole 133.

Figure 12:
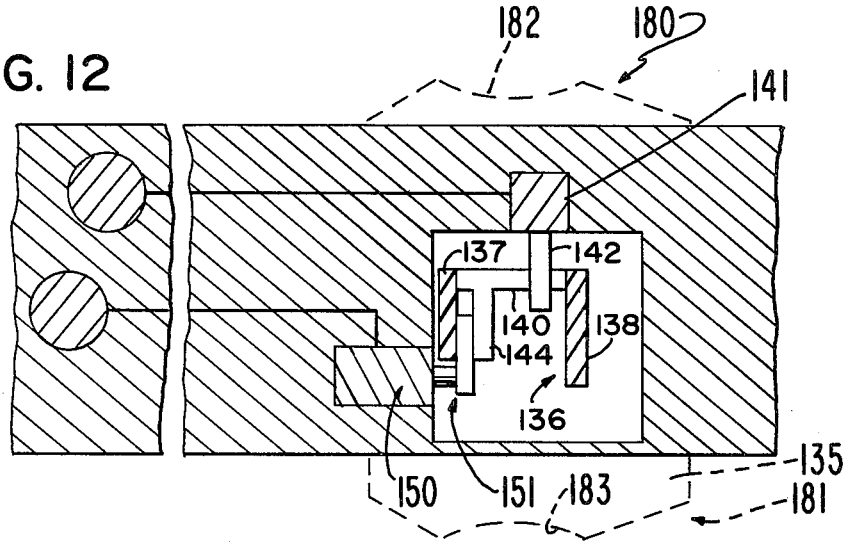
FIG. 12 is another cross-sectional plan view taken along lines 11—11 of FIG. 9 showing the movable plate assembly in its rearward rightmost position in a ski boot sole.
Figure 11:
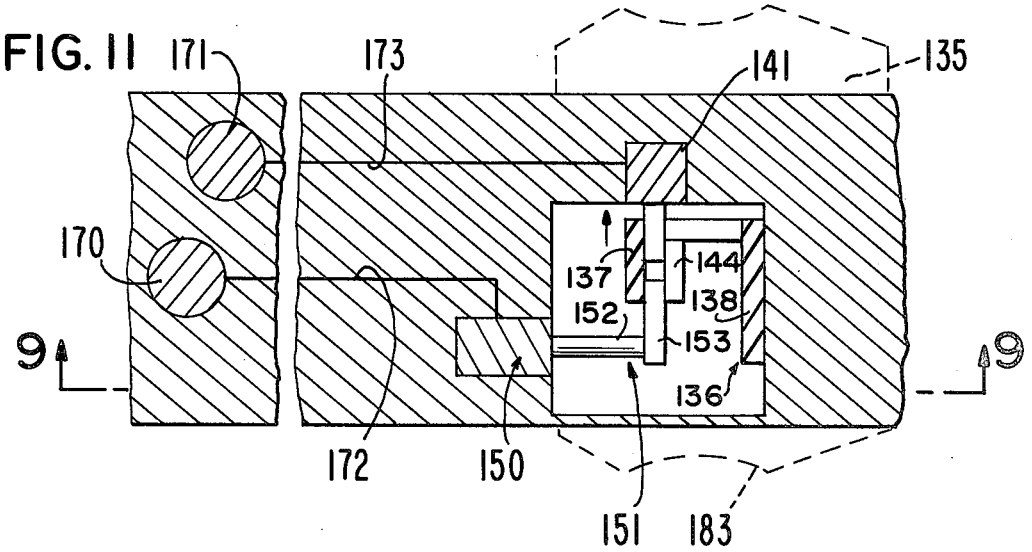
FIG. 11 is a cross-sectional plan view taken along lines 11—11 of FIG. 9 showing the movable plate assembly in its forward leftmost position in a ski boot sole.

Referring to FIGS. 11 and 12, the boot plate 135 is provided with lateral edges designated generally as 180 and 181. Centrally located in the edges 180 and 181 there is provided a pair of concave recesses 182 and 183 respectively. The edges 180 and 181 and the recesses 182 and 183 are provided for engaging side-clamping members of a releasable binding of the type disclosed in FIGS. 1 and 3.

In use, after the ski boot 130 is releasably clamped between a pair of side-clamping jaw members such as the members 2 and 3 of FIGS. 1 and 3, changes of pressure on the transducer control circuit and power supply assemblies 170 and 171 will actuate the solenoid assemblies 150 and 141, respectively. For example, during forward lean, there is a tendency to increase the pressure of the ball of the skier's boot on the sole 133, and consequently on the pressure transducer 170. With an increase of pressure on the pressure transducer 170, a signal is generated on the line 172, causing the solenoid assembly 150 to extend the piston assembly 151 toward the heel of the ski boot 130. As the piston assembly 151 is extended toward the heel of the ski boot 130 with the leg member 153 captured between the leg member 137 and the wall member 144, it causes the ski boot 130 to be pushed forwardly relatively to the movable assembly 134 and the ski to which it is secured. On the other hand, during backward lean, as the pressure of the ball of the skier's foot is removed from the transducer control circuit and power supply assembly 170, the solenoid and power supply assembly 170 draws the piston assembly 151 toward the toe of the ski boot, causing the ski boot 130 to be moved rearwardly relative to the movable assembly 134.

Since the movable assembly 134 and specifically the plate member 135 thereof is releasably secured in the side-clamping jaw members 2 and 3 of the binding of FIGS. 1 and 3, the forward and rearward movement of the ski boot 130 relative to the movable assembly 134 results in a dynamic longitudinal shifting of the skier's weight which corresponds in magnitude to the magnitude of the forward and rearward lean of the skier.

During edging, turning and other lateral skier movements, changes in the pressure of a skier's foot on the sole 133 results in corresponding changes in pressure on the pressure transducer control circuit and power supply assembly 171. For example, as the pressure on the transducer control circuit and power supply assembly 171 is increased, a signal on the line 173 causes the piston assembly 142 of the solenoid assembly 141 to move toward the longitudinal axis of the sole 133. As the piston assembly 142 of the solenoid assembly 141 moves towards the center of the sole 133, it moves the boot 130 to the side relative to the movable assembly 134. On the other hand, as pressure on the transducer control circuit and power supply assembly 171 is reduced, as by sideways leaning of the skier to the opposite side of the ski boot, the piston assembly 142 of the solenoid assembly 141 moves the ski boot 130 relative to the movable assembly 134 in the opposite direction.

So that both lateral and longitudinal movement of the ski boot 130 relative to the movable assembly 134 can occur, the wall member 140 is free to slide in the slot 143 of the solenoid assembly 141, as the solenoid assembly 150 moves the ski boot 130 longitudinally relative to the movable assembly 134. Similarly, the arm 153 of the piston assembly 151 of the solenoid assembly 150 is free to slide between the leg member 137 and the wall member 144 of the U-shaped member 136 as the piston assembly 142 of the solenoid assembly 141 moves the ski boot 130 from side to side relative to the movable assembly 134.

Figure 13:
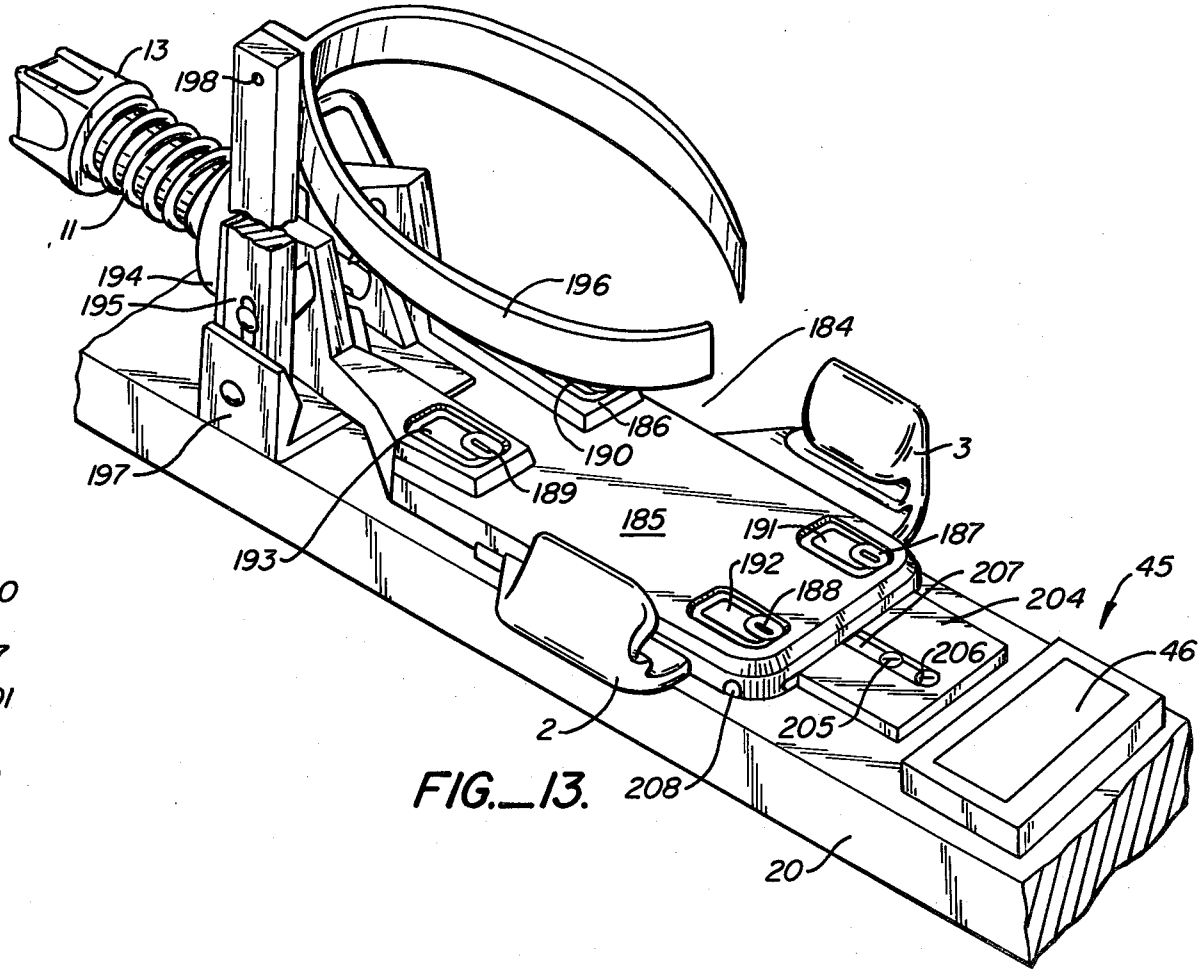
FIG. 13 is a perspective view of a mechanical embodiment of the present invention showing a leg lever assembly.
Figure 14:
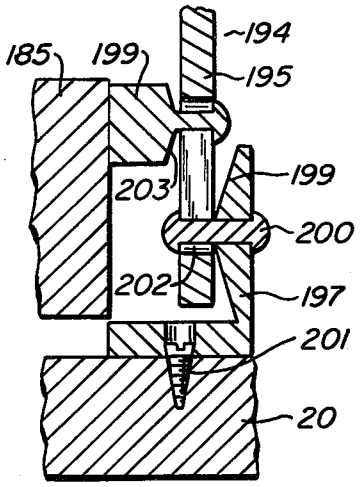
FIG. 14 is a partial cross-sectional view of the leg lever assembly of FIG. 13.

Referring to FIGS. 13 and 14, there is provided in accordance with another embodiment of the present invention a ski binding designated generally as 184 comprising a housing 185. Except as hereinafter described the ski binding 184 is substantially identical to the ski binding of FIG. 1 and operates in the same manner for releasably securing a ski boot to a ski rearward of the toe and forward of the rear of the heel of the ski boot. For convenience, those features of the binding 184 which are identical to those in the binding of FIG. 1 are identified using the same numbers used in FIG. 1.

The binding 184 is movably mounted to the ski 20 by means of a plurality of screw members 186, 187, 188 and 189. The screw members 186–189 are mounted in a plurality of widened and elongated slots 190, 191, 192 and 193 respectively.

Extending rearwardly from the rear of the housing 185 there is provided a lever assembly designated generally as 194. A comparable lever assembly may be located on the opposite side of the binding. In the lever assembly 194 there is provided a lever 195 a leg cuff 196 and a lever bracket 197. The upper end of the lever 195 is attached to the leg cuff 196 by a rivet 198 or the like. The mid portion of the lever 195 is pivotably attached to the housing 185 by a post 199. The lower end of the lever 195 is pivotably attached to the lever bracket 197 by a rivet 200 or the like. The lever bracket 197 is attached to the ski 20 by screws 201 or the like.

A guide 204 is movably mounted to the ski 20 by means of screws 205 and 206. The screw members 205 and 206 are mounted in elongated slot 207. Guide 204 is L shaped to slidably engage the housing 185 in slot 208. The guide 204 allows the binding 184 to move forwardly and rearwardly and from side to side but prevents rotational movement of the binding.

Referring to FIG. 14, the lever bracket 197 is provided with a wedge shaped surface 199 that allows the lever 195 to pivot forwardly and rearwardly and from side to side. The post 199 is rigidly attached to the housing and passes through an elongated slot 202 in the lever and includes wedge shaped shoulders 203 that allow the binding 184 to move forwardly and rearwardly and from side to side.

In operation, the ski boot is secured between the clamping members 2 and 3 and the spring steel or the like leg cuff 196 is releasably secured around the skiers leg or ski boot cuff. During a turn as a skier edges and leans forward in the binding 184, there is pivoting of the lever 195 forwardly and to one side of the ski causing forward the sideward movement of the binding on the ski. Rearward lean of the skier causes the binding to move rearwardly. The screw slots may be wide toward the forward end of binding and narrow toward the rear end of the binding such that the binding may move laterally in the forward position and is centered on the ski in the rearward position.

While a plurality of mechanical and electrical embodiments of the present invention are disclosed and described for purposes of illustrating the present invention, it is comtemplated that various modifications may be made thereto without departing from the spirit and scope of the present invention. For example, while an electrical solenoid assembly is described, the use of other types of solenoid and piston assemblies of a conventional nature may also be used, such as a reversible stepping motor activated piston assembly using a rack and pinion or worm screw assembly, an hydraulic activated piston assembly, an air or gas activated piston assembly and the like. Obviously, when non-electrical assemblies are employed, there is required a corresponding change in the source of power to operate the assembly. Thus, for hydraulic and air activated assemblies a source of hydraulic fluid and air is provided. In addition, it is contemplated that more than one solenoid assembly may be employed in a binding and that if multiple solenoid assemblies are employed, they may in certain applications be preferably placed at opposite ends of a binding. For these reasons, it is intended that references be made to the embodiments described only for the purpose of understanding the present invention and that the scope thereof be determined by reference to the claims hereinafter provided and their equivalents.

What is claimed is:

1. A ski binding for releasably securing a ski boot to a ski and being responsive to a movement of a skier for moving said ski boot relative to said ski a predetermined distance in a predetermined direction, the binding comprising means for providing a signal corresponding to the magnitude of forward, rearward and lateral leaning movements of said skier, and means responsive to the signal for moving the ski boot a proportional amount forwardly and rearwardly relative to the ski in response to the forward and rearward leaning movements of the skier and from side-to-side relative to the ski in response to the lateral leaning movements of the skier.

2. A ski binding according to claim 1 wherein said signal providing means comprises electrical signal providing means for providing an elecrtrical signal corresponding to the magnitude of said forward, rearward and lateral leaning movements of said skier and said means responsive to said signal comprises means responsive to said electrical signal for moving said ski boot relative to said ski.

3. A ski binding according to claim 1 wherein said signal providing means comprises mechanical signal providing means for providing a mechanical signal corresponding to the magnitude of said forward, rearward and lateral leaning movements of said skier and said means responsive to said signal comprises means responsive to said mechanical signal for moving said ski boot relative to said ski.

4. A ski binding according to claim 3 wherein said signal providing means comprises lever means for providing a mechanical signal and means for coupling said lever means and said moving means.

5. A ski binding for releasably securing a ski boot to a ski and being responsive to a movement of a skier for moving the ski boot relative to the ski a predetermined distance in a predetermined direction, the binding comprising:

pressure sensitive transducer means positioned and constructed for activation by a foot of the skier; and means responsive to and operatively coupled with the transducer means for moving the binding and thereby a ski boot engaged by the binding relative to the ski over a predetermined distance and direction in response to a pressure change sensed by the transducer means.

6. A ski binding according to claim 5 wherein the transducer means comprises means responsive to heel movement of said skier for moving said ski boot forwardly and rearwardly relative to said ski.

7. A ski binding according to claim 6 wherein said heel movement is heel lifting and heel lowering movement, and said moving means comprises:

means responsive to said heel lifting movement of said skier for moving said ski boot forwardly relative to said ski and to said heel lowering movement of said skier for moving said ski boot rearwardly relative to said ski.

8. A ski binding according to claim 6 wherein said moving means comprises: a heel means movable between a first and a second position in response to said heel movement of said skier; and a spring means for providing a spring force for moving said ski boot relative to said ski with said spring force as said heel means in moved between said first and said second position.

9. A ski binding according to claim 8 wherein said heel movement comprises heel lifting and heel lowering movement, and said heel means comprises:

a heel member movable from a first to a second position in response to said heel lifting movement of said skier and from said second to said first position in response to said heel lowering movement of said skier; and means for moving said ski boot forwardly relative to said ski with said spring force when said heel member is moved from its second to its first position.

10. A ski binding according to claim 5 wherein the moving means comprises first and second means responsive to and operatively coupled with the transducer means for moving the binding in a plurality of generally transverse directions with respect to the ski.

11. A ski binding according to claim 10 wherein the transducer means comprises first and second pressure sensitive transducers mounted to the ski boot and operatively coupled with the first and second means, respectively.

12. A ski binding according to claim 5 wherein the transducer means is located within the boot and is activated by a portion of the sole of the skier's foot.

13. A ski binding according to claim 5 wherein the transducer means is located for activation by a sole of the ski boot.

14. A ski binding according to claim 2 wherein the transducer means is located within the boot for activation by an instep portion of the skier's foot.

15. A ski binding for releasably securing a ski boot to a ski and being responsive to a movement of a skier for moving said ski boot relative to said ski a predetermined distance in a predetermined direction, the binding comprising:

means in the ski boot, responsive to the movement of the skier, for providing a signal; and means responsive to the signal for moving the ski boot relative to the ski in a direction and distance corresponding to the magnitude and direction of the movement of the skier.

16. A ski binding according to claim 15 wherein said signal providing means comprises means for providing an electrical signal and means for coupling said electrical signal and said moving means.

17. A ski binding according to claim 16 wherein said electrical signal providing means comprises pressure responsive means and means for mounting said pressure responsive means in a selected location in said ski boot and said signal coupling means comprises means extending from said pressure responsive means to a connecting means located on the exterior of said ski boot.

18. A ski binding for releasably securing a ski boot to a ski and for moving the ski boot relative to the ski while the ski boot is secured to the binding comprising:

means for sensing a movement of the skier; guide means permitting movement of at least a portion of the binding in a predetermined direction; and power generating means operatively coupled with the sensing means and the guide means for moving the binding portion in said predetermined direction and over said predetermined distance in responseto a movement of the skier detected by the sensing means; the sensing means, the guide means and the power generating means being located below an uppermost part of the ski boot in the binding.

19. A ski binding according to claim 18 wherein the power generating means is substantially disposed between the ski and an upper surface of a sole of the ski boot.

20. A ski binding according to claim 18 wherein the power generating means comprises a lever activated by movement of a sole of the ski boot.

21. A ski binding according to claim 18 wherein the power generating means comprises a solenoid disposed between a sole of the ski boot and the ski.

* * * * *